United States Patent [19]

Susdorf et al.

[11] 4,116,091

[45] Sep. 26, 1978

[54] DRIVE FOR AN ELECTRIC RAIL MOTOR CAR

[75] Inventors: Roman Susdorf; Heinz Engelmann, both of Berlin, Germany

[73] Assignee: Siemens Aktiengesellschaft, Berlin and Munich, Germany

[21] Appl. No.: 786,566

[22] Filed: Apr. 11, 1977

[30] Foreign Application Priority Data

Apr. 12, 1976 [DE] Fed. Rep. of Germany ..... 2616310

[51] Int. Cl.[2] ..... F16H 1/28; B60K 1/00; H02K 5/00

[52] U.S. Cl. ..... 74/801; 180/65 F; 310/89; 74/750 R

[58] Field of Search ..... 74/801, 750 R; 180/65 F, 65 E, 43 B; 310/89

[56] References Cited

U.S. PATENT DOCUMENTS

| | | | |
|---|---|---|---|
| 1,808,748 | 6/1931 | Apple | 74/801 X |
| 2,469,905 | 5/1949 | Tatlow | 74/801 |
| 2,810,844 | 10/1957 | Morrill | 74/801 X |
| 2,839,952 | 6/1958 | Ondeck | 74/750 R |
| 3,143,897 | 8/1964 | Kohm | 310/89 X |
| 3,333,482 | 8/1967 | Wildhaber | 74/801 X |
| 3,937,293 | 2/1976 | Susdorf | 74/750 R X |
| 3,979,822 | 9/1976 | Halm | 310/89 X |

*Primary Examiner*—Samuel Scott
*Assistant Examiner*—Lance W. Chandler
*Attorney, Agent, or Firm*—Kenyon & Kenyon, Reilly, Carr & Chapin

[57] ABSTRACT

An improved drive for driving the axles of an electric rail car wherein the drive includes an electric motor having a stator and a rotor arranged between the axles of the rail car and transmissions each arranged at an end of the shaft of the rotor and each including a pinion member for coupling energy from its respective rotor shaft end to a drive axle, and wherein the improvement comprises: planetary drives each arranged to couple torque from an end of the rotor shaft to the pinion of the transmission associated therewith; each planetary drive including: a sun gear formed by a geared section at the end of the rotor shaft, three planetary gears arranged in a stationary planet carrier and disposed so as to be driven by said sun gear; a hollow gear arranged to be driven by said three planetary gears and a curved gear coupling arranged between said hollow gear and the shaft of the pinion for transmitting torque thereto.

5 Claims, 5 Drawing Figures

DRIVE FOR AN ELECTRIC RAIL MOTOR CAR

BACKGROUND OF THE INVENTION

1. Field of the Invention

This invention relates to a drive for driving the two axles of an electric rail car.

2. Description of the Prior Art

Drives of the aforesaid type are well known in the art. In one particular type of drive configuration, an electric propulsion motor is disposed between the drive axles of the car and includes a rotor and a stator, the latter stator being without housing and having a lamination stack arranged between pressure plates clamped by tensioning elements. The drive further includes angle transmissions each arranged to couple torque from an end of the rotor shaft to one of the car axles via a pinion member. Each angle transmission is further provided with a transmission housing which is supported by the car axle associated therewith and which, in turn, supports the lamination stack of the stator. Bearings are further included in the transmission housings for supporting the ends of the rotor shaft and the drive is further provided with couplings for coupling each pinion of an angle transmission to its respective end of the rotor shaft, each coupling in turn being disposed between such respective end of the rotor shaft and the bearing of the angle transmission housing supporting such end.

The aforesaid drive configuration is advantageous in that the components thereof perform the function of the end bells typically employed at the ends of the electric motor, thereby eliminating such end bells and considerably reducing the weight of the drive. In particular, as above indicated, the shaft of the rotor carries the pinion members directly at its ends and such ends are supported in bearings in the transmission housings, the interposed couplings insuring centering of the rotor shaft. Furthermore, the transmission housings support the stator which has no housing. Since separate bearings for supporting the rotor shaft are eliminated the space requirement of the drive in the axial direction is also reduced.

It is an object of the present invention to adapt the aforesaid drive so that it can employ a high speed electric motor, whereby the power delivered by the drive can be increased.

SUMMARY OF THE INVENTION

In accordance with the principles of the present invention, the above and other objectives are accomplished in a drive of the above described type by further including therein planetary drives, each arranged to couple torque from an end of the rotor shaft to the drive pinion associated therewith. More particularly, each planetary drive includes: a sun gear formed by a geared portion of its respective rotor shaft end; three planetary gears supported on a stationery planet carrier and arranged to be driven by said sun gear; a hollow gear which is arranged to be driven by the planetary gears; and a curved gear coupling for connecting the hollow gear to the shaft of the pinion member.

As can be appreciated, the aforesaid planetary drives occupy very little space in the axial direction, particularly since the sun gears thereof are formed by portions of the rotor shaft ends. Furthermore, due to the use of planetary gears, the force being transmitted is evenly distributed and any offset of the axes of the hollow gear and the sun gear is equalized by the curved gear coupling which forms the connection between the hollow gear and the pinion shaft. Additionally, longitudinal movements occurring during operation due to temperature differences between the stator and the rotor are absorbed or taken up by longitudinal sliding at the gear engagements of the sun gears and the planetary gears so that the sun gears act as centering couplings permitting longitudinal movements.

As can be further appreciated with the drive of the present invention, use of the planetary drives in conjunction with the conventional transmissions results in a high step-down ratio of the torque developed by the electric motor and coupled to the axles of the car. As a result, high speed electric propulsion motors can be employed in the drive, such as, for example, asynchronous motors.

It is also advantageous in the drive of the present invention to arrange the ends of the rotor shaft centrally with respect to the planetary gears and to support such ends in the shafts of their respective pinions via pretensioned cup springs and thrusts bearings. Such support provides automatic centering of the rotor shaft and requires relatively few components. In particular, the thrusts bearings equalize the different speeds of the rotor shaft and the pinion shafts while the cup springs hold the rotor shaft in its intended position.

In a further aspect of the invention and in order to obtain less bending in the rotor shaft, the drive of the invention can be configured so as to include anti-friction bearings arranged in the planetary carriers for supporting the ends of the rotor shaft. With this type of support for the rotor shaft, the support points are shifted toward the middle of the shaft, thereby preventing bending thereof.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
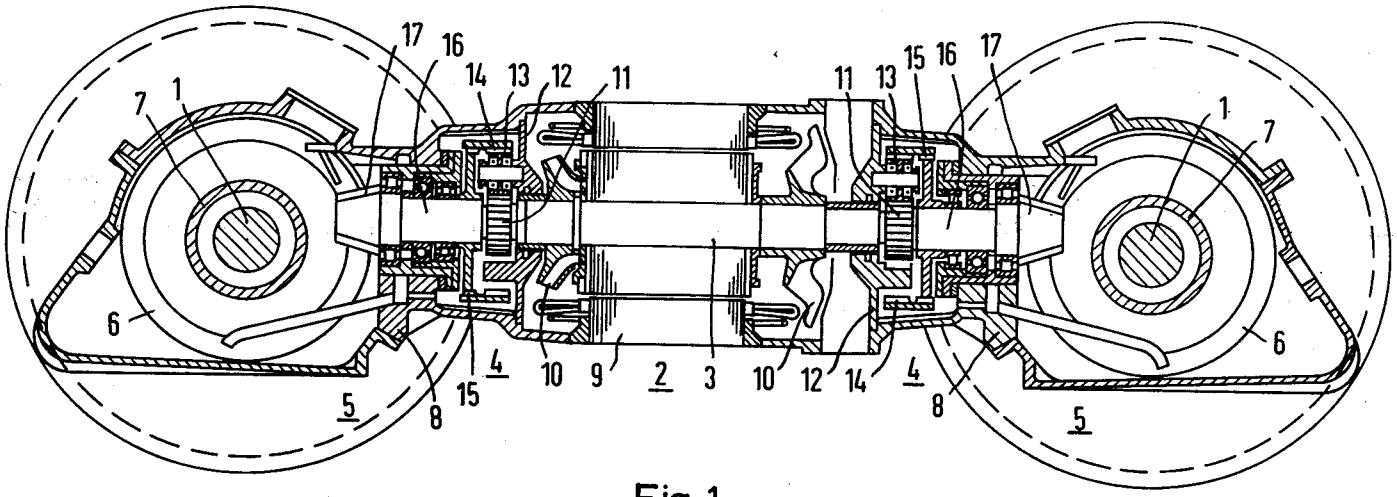
FIG. 1 illustrates a drive for an electric rail car in accordance with the principles of the present invention.

FIG. 1 shows a longitudinal cross-section through a drive in accordance with the principles of the present invention. The drive provides driving power for the axles 1 of an electric rail car and includes a propulsion motor 2 which is arranged between the axles 1 in the longitudinal direction of the car. The aforesaid motor 2 is a high speed motor, thereby requiring at each end of the shaft 3 of the rotor of the motor a means having a high step-down ratio for coupling the torque of the rotor to the respective axles 1. In accordance with the invention, the aforesaid means at each end of the rotor shaft 3 comprises a planetary drive 4 and an angle transmission 5 connected thereto.

More particularly, each angle transmission 5 includes a bevel gear 6 arranged on a hollow shaft 7 which surrounds one of the driving axles 1. The hollow shaft 7 of each transmission 5 and the drive axle 1 connected thereto are coupled in a conventional manner via elastic couplings which have not been shown in the drawing. Each transmission 5 further includes a transmission housing 8 which is supported on the hollow shaft 7 associated with the transmission.

As above indicated, the rotor shaft 3 around which is arranged the stack of stator laminations 9 and the fans 10 is able to appropriately drive the axles 1 by including in the drive the planetary drives 4. Each of the planetary drives 4 is arranged to couple torque from an end of the rotor shaft 3 to one of the transmissions 5. Each includes a sun gear 11 which is formed by a geared portion of its respective end of the rotor shaft 3 and by three planetary gears 13 which are supported in a stationary planet gear carrier 12. The planet carriers 12 are fastened to the respective transmission housings 8 of the transmissions 5 and each is arranged such that its planetary gears 13 are driven by their respective sun gear 11.

The planetary drives 4 also include hollow gears 14 arranged to be driven by the planetary gears 13 and to transmit, via curved gear couplings 15, torque to the pinion shafts 16 of the transmissions 5. Each of the pinion shafts 16 is, in turn, coupled to a pinion member 17 which engages with the bevel gear 16 of its respective transmission 5. The latter in turn drives its respective driving axle 1.

With the planetary drives 4 arranged as aforesaid, each curved gear coupling 15 equalizes a possible offset of the axes of its respective hollow gear 14 and the sun gear 11. As a result, a self-centering of the axes of the hollow gears 14 and sun gears 11 results.

Figure 2:
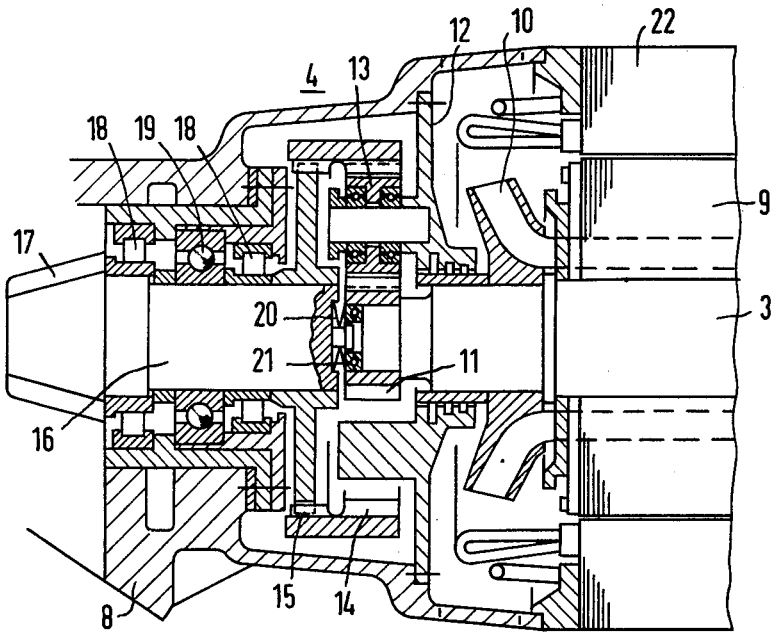
FIG. 2 shows an enlarged section of an end of the drive of FIG. 1.

As can be seen more clearly in FIG. 2, the rotor shaft 3 and the two pinion shafts 16 of the transmissions 5 are supported by bearings provided in their respective transmission housings 8. In particular, two anti-friction bearings 18 provide radial support of each pinion shaft 16 and a further anti-friction bearing 19 provides axial support thereof. The rotor shaft 3, in turn, is centrally supported at its ends radially between the teeth of the sets of planetary gears 13. Furthermore, in the axial direction, pretensioned cup springs 20 and thrusts bearings 21 support the ends of the rotor shaft within the pinion shafts 16 such that the rotor is always returned to the magnetic center of the drive. The thrusts bearings 21, furthermore, provide the additional function of absorbing or taking up the different speeds of the pinion shafts 16 and the rotor shaft 3.

It should be also pointed out that changes in length of the rotor shaft 3 relative to the stator 22 of the motor 2 or to the transmission housing 8 are taken up by the gearing of the sun gears 11 and the planetary gears 13.

Figure 3:
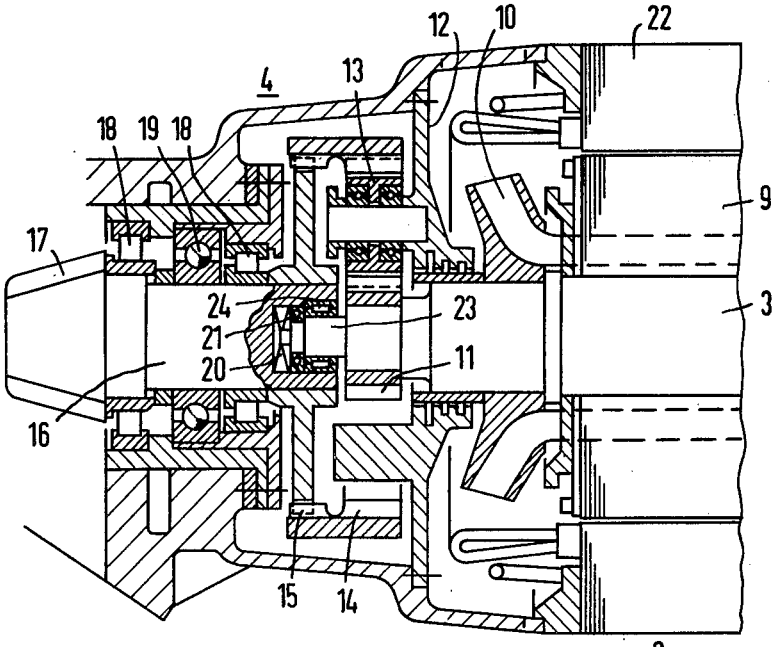
FIGS. 3 through 5 show the aforesaid end section of FIG. 2 modified to include various different support arrangements for the rotor shaft of the invention.

FIG. 3 shows a modification of the embodiment of FIGS. 1 and 2 wherein the rotor shaft 3 is provided with additional radial support within each of the pinion shafts 16 via a journal 23 and anti-friction bearings designed as needle bearings 24. This type of radial support for the rotor shaft 3 is somewhat more expensive than merely providing such support via the planetary gears 13 alone, but the centering of the rotor has significantly less play and therefore is much more accurate.

Figure 4:
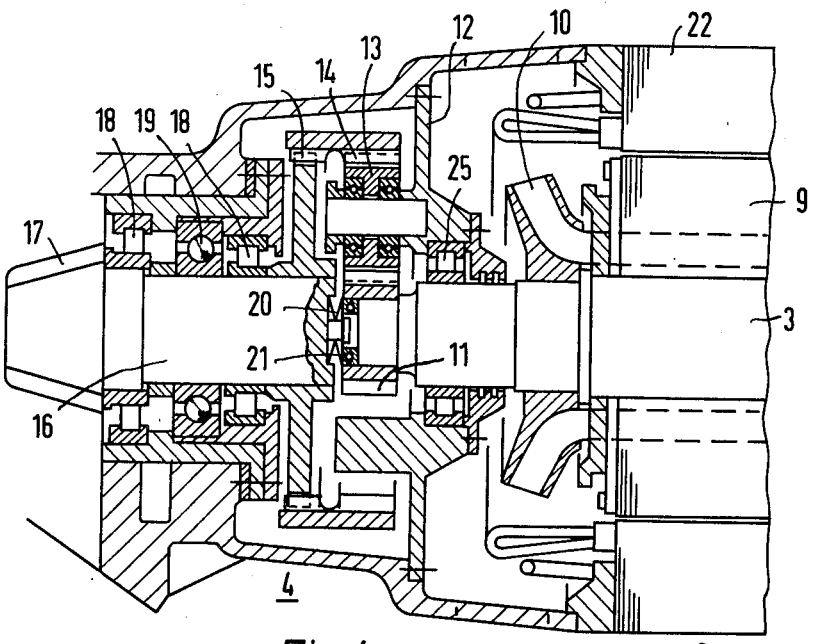

FIG. 4 shows a further modification of the support of the rotor shaft 3 of the drive of FIGS. 1 and 2 wherein radial support for the shaft 3 is provided by anti-friction bearings 25 which are disposed in the planet carrier 12. With this type of radial support the radial support points of the rotor shaft 3 are shifted toward the middle of the rotor and bending of the rotor shaft is significantly reduced, which, in turn, has a favorable effect on the critical speed.

Figure 5:
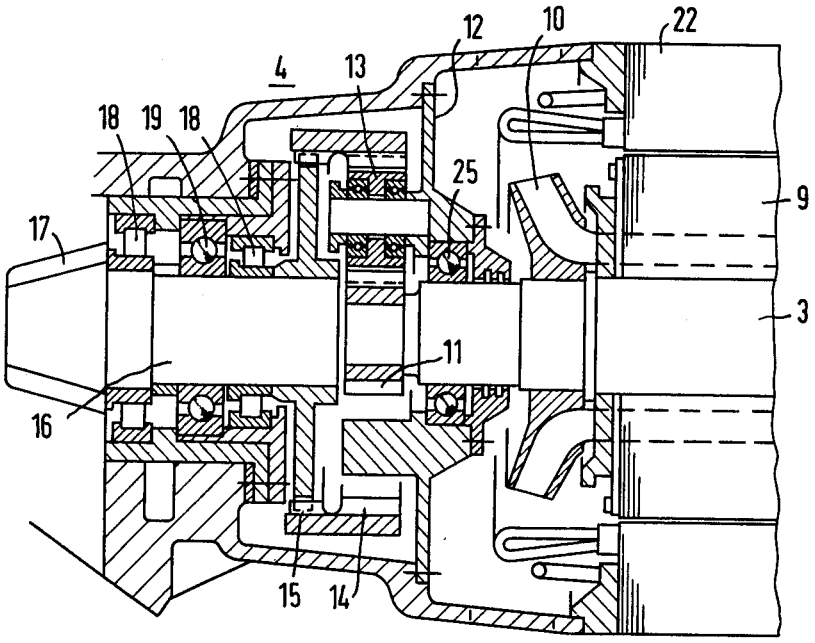

Finally, FIG. 5 shows a further modification of the support of the rotor shaft 3 of the FIGS. 1 and 2, wherein anti-friction bearings 25 are arranged on the side of the shaft ends in the planet carriers 12 to provide both axial as well as radial support of the rotor shaft 3. Furthermore, with this configuration in order to insure length equalization during warm-up, the anti-friction bearing mounted on the shaft end and not shown in the drawing is designed as a loose bearing.

What is claimed is:

1. In a drive for use with an electric rail car having two axles, the drive comprising: a propulsion motor disposed between said axles and having a stator and a rotor, said stator being without housing and including a lamination stack arranged between pressure plates clamped by tensioning elements; angle transmissions responsive to said motor for coupling drive power to said axles, each of said transmissions including a pinion adapted to be connected to at least one of said axles and disposed at an end of the shaft of said rotor, and a transmission housing adapted to be supported by said one drive axle and supporting the lamination stack of said stator, said transmission housing including a bearing for supporting said end of said shaft; and a coupling for connecting the pinion of one of said transmissions to its respective end of said shaft, said coupling being disposed between said respective shaft end and the bearing supporting said respective shaft end so as to permit longitudinal shifts and centering of said rotor shaft; the improvement comprising:

planetary drives, each disposed within one of said transmission housings between the pinion shaft of the of said one housing and the end of said rotor shaft supported in said one housing and including:

a sun gear formed by a geared portion of said end of said shaft supported in said one housing:

a stationary planet carrier;

planetary gears supported on said carrier and driven by said sun gear;

a hollow gear arranged to be driven by said planetary gears; and a curved gear coupling for coupling said hollow gear to said shaft of the pinion supported in said one housing.

2. In a drive in accordance with claim 1, the improvement further comprising:

means for supporting each end of said rotor shaft within said pinion shaft associated therewith including pretensioned cup springs and a thrust bearing;

and the ends of said rotor shaft are radially centered with respect to said planetary gears.

3. In a drive in accordance with claim 1, the improvement further comprising:

journals for centering the ends of said rotor shaft within their respective pinion shafts;

and anti-friction bearings for supporting the ends of said rotor shaft within their respective pinion shafts.

4. In a drive in accordance with claim 1, the improvement further comprising:

anti-friction bearings disposed in said planet carriers for radially supporting the ends of said rotor shaft.

5. In a drive in accordance with claim 4, the improvement wherein:

each of said anti-friction bearings is configured on one side as a combined radial and thrust bearing.

* * * * *